United States Patent [19]

Yanusko et al.

[11] Patent Number: 4,882,971

[45] Date of Patent: Nov. 28, 1989

[54] LINKLESS AMMUNITION TRANSPORTER

[75] Inventors: David P. Yanusko, Pottstown, Pa.; Harold C. McMillan, Cherry Hill, N.J.; Edmund G. Kline, West Chester, Pa.

[73] Assignee: Teleflex, Incorporated, King of Prussia, Pa.

[21] Appl. No.: 200,014

[22] Filed: May 27, 1988

[51] Int. Cl.[4] ..... F41D 10/02; F41D 10/26; F41F 9/02; F41F 9/06

[52] U.S. Cl. ..... 89/33.02; 89/33.1; 89/34

[58] Field of Search ..... 89/33.02, 33.1, 34

[56] References Cited

U.S. PATENT DOCUMENTS

| | | | |
|---|---|---|---|
| 1,330,873 | 2/1920 | Hulse | 89/33.02 |
| 2,464,689 | 3/1949 | Jackson | 89/33.01 |
| 2,910,917 | 11/1959 | Herlach et al. | 89/33.02 |
| 3,696,704 | 10/1972 | Backus et al. | 89/33.02 |
| 4,004,490 | 1/1977 | Dix et al. | 89/33.02 |
| 4,005,633 | 2/1977 | Kirkpatrick | 89/33.02 |
| 4,127,055 | 11/1978 | Hotlinger et al. | 89/33.02 |
| 4,457,208 | 7/1984 | Golden | 89/33.02 |
| 4,492,144 | 1/1985 | Dix | 89/34 |
| 4,589,325 | 5/1986 | Müller et al. | 89/33.02 |
| 4,742,756 | 5/1988 | Mannhart | 89/330.02 |
| 4,777,863 | 10/1988 | DeHaven et al. | 89/33.1 |

*Primary Examiner*—David H. Brown

*Attorney, Agent, or Firm*—Steele, Gould & Fried

[57] ABSTRACT

A transporter for storing and feeding linkless rounds of ammunition, including live rounds as well as spent cartridge casings, has a generally cylindrical drum frame assembly with longitudinal rails that retain the rounds in rows, the rounds facing radially inwardly toward an axis of the drum. The drum rotates slowly and continuously during operation, bringing the rows of rounds into the area of an internal conveyor for removing rounds from one row while preferably returning spent cartridge casings to another row, proceeding row by row around the drum. The internal conveyor is preferably parallel to the axis of the drum and parallel to the rails, being mounted at least on one end of the drum by a radial arm. Drive and gearing means slowly advance the radial arm in synchronism with rotation of the drum during processing of a given row of rounds, and angularly index the internal conveyor stepwise to a next row upon completion. Preferably the drive means includes a cam and cam follower, one of which is on the radial arm and the other of which rotates on a fixed axis spaced from the drum axis.

13 Claims, 3 Drawing Sheets

LINKLESS AMMUNITION TRANSPORTER

BACKGROUND OF THE INVENTION

1. Field of the Invention

This invention relates to the field of linkless ammunition handling, using a storage drum or magazine with longitudinal rails holding inwardly directed rounds of ammunition and/or spent cartridge casings. More particularly, the invention relates to a method and apparatus for loading and unloading the rows of rounds in an ammunition drum of this type.

2. Prior Art

In magazines for feeding automatic and semi-automatic weapons, it has long been known to store rounds along longitudinal rails in a drum, the rounds facing radially inwardly, and means being provided to load and unload the rounds to and from the rails. U.S. Pat. No. 1,330,873-Hulse discloses a magazine wherein the rails are formed by wire-like elements, and the rounds are advanced by a central helix that pushes all the rounds in the entire drum simultaneously toward one end of the drum. This same type of device is used in connection with magazines for high rate of fire weapons and also for separately mobile transporting devices wherein the drum can be temporarily connected to an ammunition storage system in an aircraft, gun emplacement or the like, the transporter being used to load live rounds into the gun emplacement and to remove spent rounds, i.e., empty cartridge casings, therefrom.

A device for charging linked ammunition from a box into an aircraft is shown in U.S. Pat. No. 2,464,689-Jackson. A more modern apparatus wherein a storage drum is employed for loading and unloading is shown with several variations in U.S. Pat. Nos. 3,696,704-Backus, et al; 4,004,490-Dix et al; and, 4,005,633-Kirkpatrick. The storage drum is wheeled up to an aircraft and attached thereto as shown in Backus et al. The rounds are retained in longitudinal rails by means along the rails engaging the extractor flanges of the rounds as shown in Kirkpatrick. All the rounds are pushed along the rails by a central helix. An end-mounted means for transferring the slow longitudinal motion of the whole supply of rounds, into a faster circumferential motion for feeding the rounds to an external conveyor, is shown in Dix et al. The teachings of these patents are incorporated herein.

In a storage drum having longitudinal rails for retaining the rounds in rows, some means must be provided for moving the rounds down the rails to devices at one or both ends for transporting the rounds, chambering the rounds or otherwise handling them as needed. In the helix-type devices, the drum is held stationary and the helix is rotated to push the rounds along. While it is not necessary to move the drum, all the rounds must be moved at once, which is rather demanding in that all the rounds must be accelerated and decelerated when starting and stopping. Furthermore, contact between the helix and the individual rounds is not extensive or positive, and a jam caused for example by the extractor flange of a round catching in a longitudinal rail, can permanently deform the helix.

U.S. Pat. Nos. 4,127,055-Hottinger et al and 4,589,325-Muller et al relate to magazines for gun emplacements rather than to transport means for loading and unloading the gun emplacements. Nevertheless, the magazines are characterized by cylindrical storage-drums in which the rounds are held by their extractor flanges at a radially-inward orientation. In these patents the rounds are unloaded from the magazine in individual rows. Of course the objective is to have a continuous high speed stream of rounds being fed. Therefore, some means must be provided to accelerate and move a given row of rounds and to advance smoothly to the next row. In the Muller patent, the drum rotates continuously and a helical pushing device located externally of the drum engages a pushing tab that protrudes to engage the last round in the round-carrying rails. The external helix must follow a partly circumferential path while maintaining engagement between the pushing tab and the helix such that a complete row can be unloaded before rotation of the drum carries the pushing tab out of reach of the helix. Muller discloses a chain drive mechanism as an alternative to the helix. An endless chain conveyor has two tabs attached to links of the chain for pushing the rounds. Each tab is engageable behind an endmost round in a row. The chain is inclined relative to the drum axis and relative to the rails, whereby the pusher follows the path of an endmost round in the row as the round both advances along the rail and is carried around a certain angle of the drum's circumference due to rotation of the drum. This causes the pushing means for unloading the rails, e.g., the chain drive mechanism, to occupy the space of several rails of rounds. It is readily not possible to handle unloading and loading with the same pushing conveyor because the angle of inclination needed for loading is opposite the angle needed for unloading. Therefore, if two pushing conveyors were to be provided, one for loading and one for unloading, the pushing conveyors would occupy a substantial space and would present mechanical difficulties for a number of reasons including the fact that the pushing conveyors could not easily be arranged to follow the circumferential path of the rounds.

The present invention enjoys the advantages of a chain conveyor for moving individual rounds, but unlike the prior art arranges the conveyor chain on an indexing mechanism that allows the chain to be disposed parallel to the axis of the drum and parallel to each of the rows. Accordingly, loading and unloading can be accomplished in a narrow space, for example the space of three rows. The chain conveyors for loading and unloading are provided with a plurality of protruding pushing mechanisms, preferably one for every round in a row, reducing the incidence of jamming which otherwise could be caused by pushing a row of rounds from the endmost round in the row. The loading and unloading internal conveyor chains are placed directly within the drum in the area otherwise occuppied by the rounds. The internal conveyors are mounted with respect to the drum on arms aligned radially with respect to the drum axis. An indexing drive such as a cam means is provided to slowly advance the chain conveyors circumferentially in synchronism with the slow rotation of the drum until a complete row is loaded or unloaded, whereupon the drive halts the internal conveyor and simultaneously indexes the chain conveyor circumferentially to a next row, producing a continuous succession of rounds and returning a continuous succession of spent cartridge casings to the drum.

SUMMARY OF THE INVENTION

It is an object of the invention to produce a high density storage container for rounds of ammunition for high speed feeding, characterized by minimum weight and complexity, and a minimum incidence of jamming.

It is another object of the invention to provide means for producing and synchronizing intermittent motion and positioning of a linear conveyor, to the motion of a rotating drum having longitudinal rails to be unloaded by the conveyor.

It is a further object of the invention to produce a storage container that can be conveniently attached to either an ammunition utilization device (e.g., a gun magazine) or a means for replenishing the storage container.

It is another object of the invention to produce an ammunition storage device of sufficiently low weight and low inertia that it is easily powered as an auxiliary load on the drive motors of the high rate gun, the replenishing device or other means to which the storage device is attached.

These and other objects are accomplished by a transporter for storing and feeding linkless rounds of ammunition, the ammunition possibly including not only live rounds but also spent cartridge casings. The transporter has a generally cylindrical drum frame assembly with longitudinal rails that retain the rounds in rows, the rounds facing radially inwardly toward an axis of the drum. The drum rotates slowly and continuously during operation, bringing successive rows of rounds into the reach of an internal conveyor for removing rounds from one row while preferably returning spent cartridge casings to another row, and proceeding row by row around the drum. The internal conveyor is preferably parallel to the axis of the drum and parallel to the rails, being mounted at least on one end of the drum by a radial arm. The internal conveyor moves rounds to and from an end ring on the storage drum that rotates faster than the storage drum, carrying the rounds around a circular path at full speed. Drive and gearing means slowly advance the radial arm in synchronism with rotation of the drum during loading/unloading of a given row of rounds. The drive and gearing means halt the internal conveyor and angularly index the internal conveyor to a next row of rounds upon completion of one row. Preferably the drive means includes a cam and cam follower, operative to position the radial arm relative to a fixed axis spaced from the drum axis. The drive and gearing means operatively connect the drum, the internal conveyor, the cam, and the end ring on the storage drum to which the rounds are unloaded.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein.

DETAILED DESCRIPTION OF THE PREFERRED EMBODIMENTS

The linkless ammunition transporter of the invention is a part of a system for handling large quantities of ammunition at high speed, for loading the magazines of high rate of fire guns, especially the machine guns of aircraft. The transporter engages with an external conveyor that passes unconnected rounds and spent cartridges back and forth between the transporter storage drum and an aircraft. The device is also connectable in the same way to a replenisher device which fills the transporter, sorting live rounds from spent cartridge cases and accepting bulk ammunition in random orientation.

Figure 1:
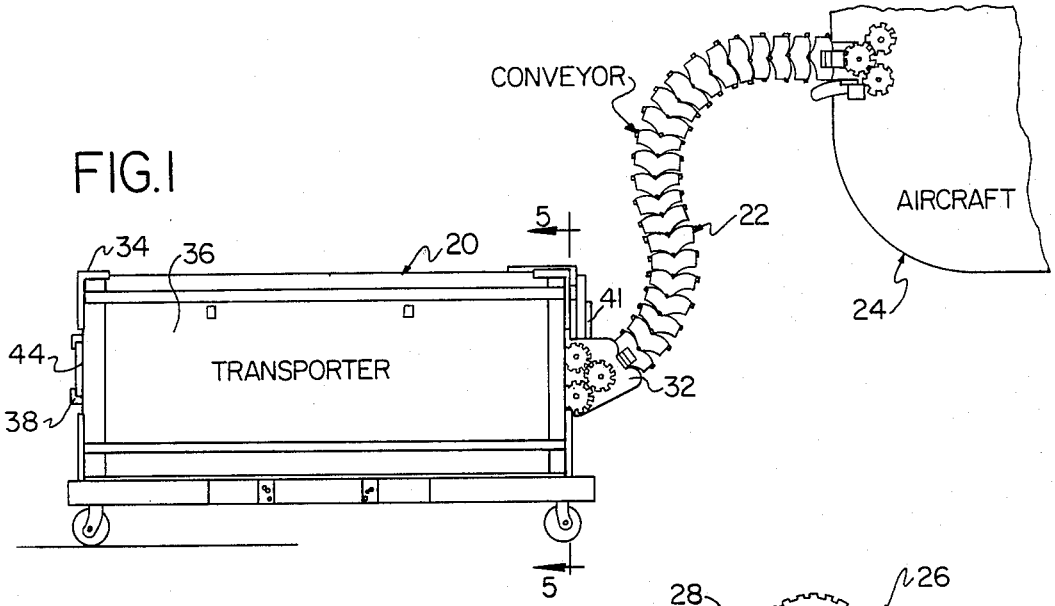
FIGS. 1 and 2 are elevation views of the linkless ammunition transporter of the invention, shown connected respectively to a replenisher and to an aircraft.
Figure 2:
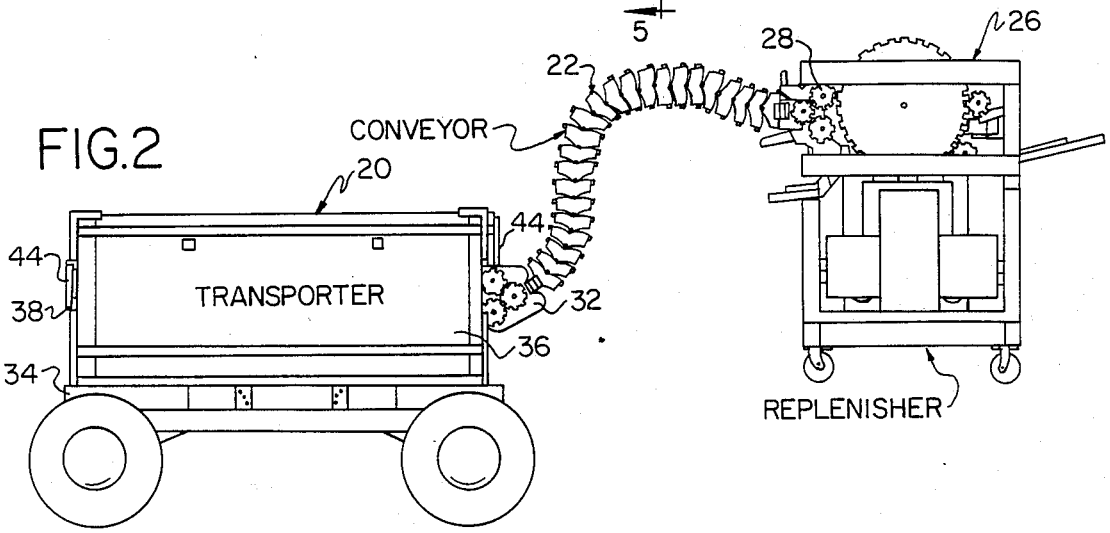

FIG. 1 illustrates connection of the transporter 20 with an aircraft 24. A conveyor section 22, external to the transporter and to the aircraft, passes rounds outwardly from the transporter to the aircraft and receives spent cartridges and/or unfired live rounds from the aircraft. It is also possible to operate the transporter 20 in a bypass mode wherein the rounds simply move in a loop, i.e., being cycled into and out of transporter 20. The transporter 20 is preferably mobile and can be provided with wheels or the like for movement about on the decks of naval vessels or the like or can be carried on a wheeled dolly (FIG. 2). The same transporter 20 and conveyor 22 can be attached to a replenisher 26 as shown in FIG. 2, the replenisher and the aircraft having the same external configuration for mating with the distal end of the external conveyor 22. The replenisher 26 accepts handfed, oriented loose rounds and unoriented loose rounds, sorts them and orients them correctly, and passes the rounds along the conveyor 22 to the transporter 20. In each case, the transporter 20, the magazine of the aircraft 24 and the replenisher 26, simply pass linkless rounds in a continuous high speed stream, at about 100 to 6,000 rounds per minute. The magazine typically operates at 6,000 rounds per minute; the transporter at 800 to 1,000; and the replenisher at about 100. The rounds are oriented such that the longitudinal axes of the rounds are perpendicular to the direction of motion of the rounds, which move about 40 cm per second. This rate of loading and unloading can be increased, for example to accommodate the maximum feeding speed of the aircraft gun, on the order of 6,000 rounds per minute. The optimum feeding speed is about 830 rounds per minute. The system typically feeds 20 mm rounds, such as standard M56A3 ammunition, but other sizes are possible. The particulars of the gun magazine in aircraft 24, and particulars of the means mating an external conveyor assembly 22 with the gun magazine in aircraft 24 for feeding can be found, for example, in the prior art mentioned hereinabove, which is hereby incorporated by reference.

Transporter 20 consists of a stationary housing carrying a drum frame assembly, i.e., a rotatable cylindrical inner drum frame having a plurality of rails aligned longitudinally along an inner circumference of the cylinder and an outer stationary frame. The rails define channels for receiving bases of the rounds and the rails have on one or both sides of each channel a transverse flange running longitudinally along the rail engaging the extractor flange located at the base of each round. The rails orient the rounds facing radially inwardly toward a central axis of the transporter drum and the transverse flange keeps the rounds from dropping out of the channels between the rails due to gravity.

Figure 3:
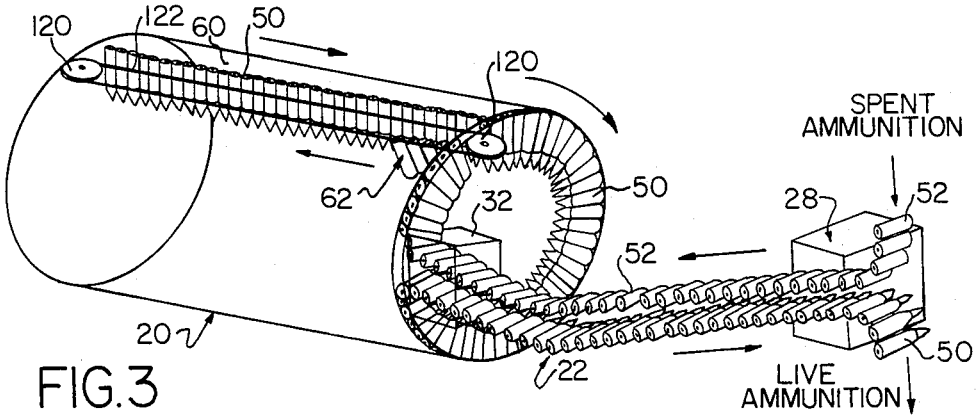
FIG. 3 is a schematic illustration, in perspective, of the paths followed by the live rounds and spent cartridge casings according to the invention.

FIG. 3 schematically illustrates the path of live rounds 50 and spent rounds 52 to and from the replenisher or aircraft to which the transporter is attached. Transporter 20 can be a separately movable element having casters or the like as shown in FIG. 1, or can be a fixed or otherwise mounted structure as shown in FIG. 2. In any event, the transporter 20 has a housing 34 carrying a rotatable inner drum 36 defining the round-carrying rails. In FIG. 3, a row 60 of live rounds 50 is being advanced out of transporter 20. At the same time a row 62 of spent rounds 52, i.e., empty cartridge casings and/or unfired live rounds, are being returned to the transporter assembly.

The simultaneous movement of rows of rounds 50, 52 in opposite directions is driven by an internal conveyor with pulleys or sprockets 120 at either end and an endless chain or belt 122 running parallel to an axis of rotation of the transporter 20 and also parallel to the individual longitudinal rows 60, 50. FIG. 3 shows the live rounds proceeding outwardly and spent rounds proceeding inwardly. It is also possible to operate the transporter in a bypass mode in which the rounds at the distal end of external conveyor 22 are simply routed back to transporter 20, from which they came. Interface unit 28 at the distal end of conveyor 22 is switchable between a round-conveying mode and a bypass mode. A counter 66 as shown in FIG. 4 or other means are preferably provided for maintaining a non-resettable count of the rounds passing a certain point.

Figure 6:
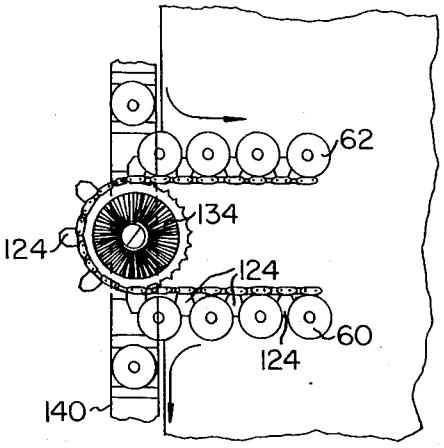
FIG. 6 is a partial section view showing progression of rounds onto and off of the internal conveyor, taken along lines 6—6 in FIG. 7.
Figure 7:
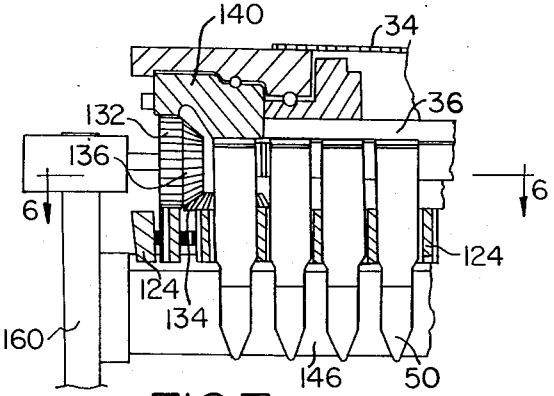
FIG. 7 is a partial section view taken along lines 7—7 in FIG. 5.
Figure 4:
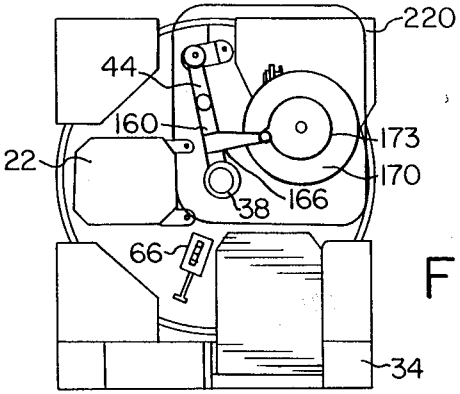
FIG. 4 is an end elevation view of the transporter, showing the means for positioning the internal conveyor.
Figure 5:
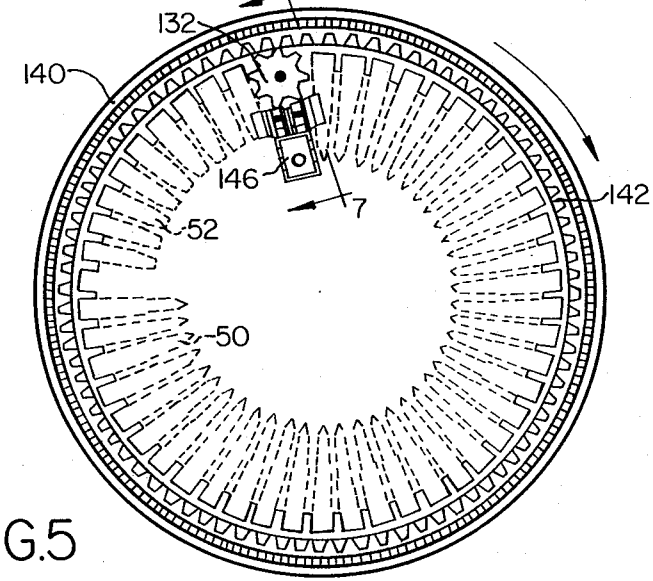
FIG. 5 is a partial section view showing the transporter end ring and internal conveyor, taken along lines 5—5 in FIG. 1.

FIGS. 4 and 5 illustrate the mounting of the internal conveyor and its position within the area occuppied by the rounds. The internal conveyor is mounted on end arms 44, disposed radially. End arms 44 are pivotable on a central shaft 38 of the transporter drum. Gears are provided for slowly and continuously rotating the drum while at the same time the transporter cycles rounds in and out. The rounds move down their respective rows (one row at a time) and onto a fast-rotating end ring 140 as seen in FIGS. 6 and 7, which moves the rounds around a circular path intercepted by transition unit 32 (FIGS. 1 and 2) leading to and from external conveyor 22.

In order to engage internal conveyor chain 122 against successive rows to rounds, means are provided movably to position sprockets 120, to which the internal conveyor chain 122 is mounted. Sprockets 120 are moved such that the chain position remains fixed relative to the slowly rotating drum while the chain moves around sprockets 120 at the position of one of the rows 60, 62. Therefore, sprockets 120 are caused to track along with the drum until all the rounds in that row have been loaded or unloaded, whereupon the chain is stopped as sprockets 120 are moved relative to the drum to advance the internal conveyor sprockets 120 to the next row. Gearing and cams preferably accomplish this motion, as explained more fully hereinafter.

The rounds being moved into and out of the longitudinal rows 60, 50 in the drum pass into and out of a circumferential path defined by the transporter ring 140 at one end of the drum. Ring 140 rotates much faster than the drum, the rounds being carried around a circular path at full feeding speed, namely the same linear speed as conveyor chain 122. Adjacent the endmost sprocket of the internal conveyor, the rounds are placed onto the transporter ring, whereupon they progress as shown in FIG. 3 about 270 degrees around the circumference of the drum before being extracted from the transporter ring by a transition unit 32 leading to external conveyor 22, attached to the aircraft or to the replenisher. Returning spent rounds (or unused live rounds) likewise move into the transporter ring from transition unit 32 on the transporter side of conveyor 22, in this case moving only about 90 degrees around the circumference of the transporter ring before being guided off the transporter ring and into one of the longitudinal rows. A similar interface box 28 is disposed between external conveyor 22 and the aircraft. FIG. 6 illustrates the passage of the rounds onto and off of the transporter ring 140.

The rotation of the inner drum 36, the rotation of the sprockets 120 of the internal conveyor, the fast rotation of transporter ring 140 and the oscillating movement by which the conveyor sprockets 120 are moved relative to the continuously-moving drum, are all driven synchronously from a common drive. A gearbox 220, which will be explained in more detail hereinafter, is operatively connected to each of the foregoing moving parts. A gear-connected chain link mechanism is also provided in conveyor assembly 22, synchronizing the external conveyor with transporter ring 140 and with the bevel gears 134 fixed to conveyor sprockets 120. Accordingly, the overall operation is synchronized and preferably is driven from a power input at the aircraft 24, for example at a wrench receiving adoption on a shaft engageable with a pneumatic wrench or hand crank. Alternatively, other power input shafts can be used, for example in the replenisher 26, transporter 20, or conveyor 22. All the rounds in the transporter are passed around the defined loop during one full rotation of the slowly rotating transporter drum assembly 20. Each row preferably holds fifty rounds, and the drum assembly preferably has fifty row-defining rails. The rails and the transport ring 140 each hold rounds of ammunition by their bases, preferably by flanges engaging behind the extractor flange of the rounds on one or both sides. Due to the specific operation of the internal conveyor, not all of the fifty rails are actually filled, even at full capacity. Two rails are being loaded/unloaded and two of the remaining rails are inaccessible behind the internal conveyor sprockets 120 and chain 122.

The movable inner drum frame defines a cylinder but rather than being a closed tube is actually formed of rails attached to the inside diameter of a ring at each end of the drum. The front end of the drum defines a gear with radially outward teeth which engage gear teeth in the gearbox 220 for driving rotation of the drum. The transporter ring 140 is disposed to rotate on the end of the drum, and has radially inward teeth for the gearbox and axially outward teeth for transition unit 32, leading to the external conveyor.

The rails in the inner drum frame 36 can be extruded metal parts, attached to the inner drum frame end rings. The stationary housing of the device preferably includes a drum skin, namely a stationary cylindrical covering of sheet metal forming part of the outer housing 34, inside which the round-carrying drum rails turn with inner drum frame 36 during operation. In addition, the stationary housing has two frame ends, covering and protecting the internal mechanism and providing a stationary base for gearbox 220.

The inner drum of the drum assembly, namely the rails and the end rings to which the rails are attached, rotates freely inside the stationary external drum skin and frame ends, for example on ⅜ inch diameter ball bearings. The gearbox and other external frame assemblies of the apparatus, are shown in FIG. 4, mounted on the front side drum end cover of the outer housing 34. Immediately behind the housing at the front end, the rotating transporter ring assembly is disposed. This assembly is shown in FIG. 5, and is the means by which the loaded and unloaded rounds are brought to and from the transition unit 32, located at a gap between the live rounds and spent rounds on the left in FIG. 5.

Figure 10:
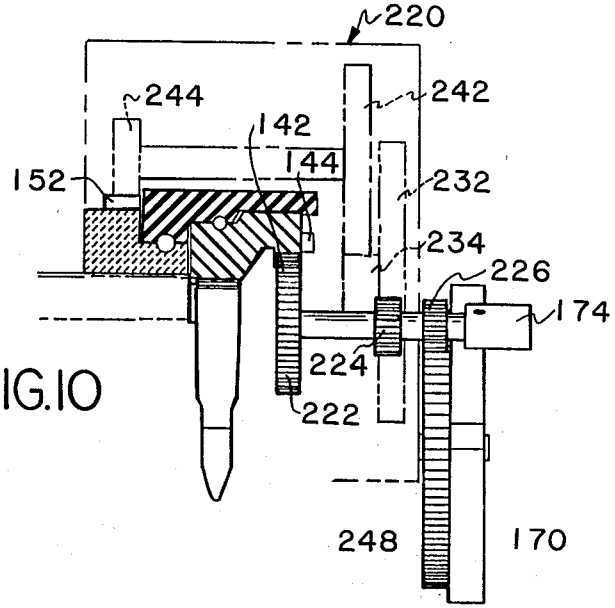
FIG. 10 is a partial longitudinal section showing the internal workings of said gearbox.

The transporter ring has inwardly directed channel means for each of the rounds carried in the transporter ring. Like the longitudinal rails, the channels on the inside diameter of the transporter ring are provided with one or more transverse flanges that engage the extractor flanges of the rounds. These flange-engaging means, as shown in FIG. 10, extend parallel to the longitudinal axis of the drum and engage the groove behind the extractor flange on each round, at least on one side thereof. The transporter ring assembly shown has fifty retaining pockets for rounds, i.e., space for one full row of rounds from the longitudinal rails. The transporter ring preferably has two hundred fifty radially inward facing gear teeth 142, engaging with a conveyor drive gear 132, by which the conveyor sprockets 120 are positioned during operation. Transporter ring gear teeth 142 also engage with the gearbox 220.

The internal conveyor is shown in detail in FIGS. 5, 6 and 7. The front end conveyor sprocket 120 is fixed on a shaft with a bevel gear 134, which engages a corresponding bevel gear 136 fixed on a shaft with the conveyor drive gear 132. Therefore, regardless of oscillation of the arm 160, to which the conveyor sprocket 120 arrangement is fixed, the operation of the internal conveyor 122 and transporter ring 140 remain exactly synchronized.

The arrangement of the chain or belt 122 of the internal conveyor inside the drum area places pushing protrusions 124 of chain or belt 122 at a point near the center of gravity of the rounds. Therefore, during acceleration and deceleration, the rounds are not likely to be tilted out of their correct alignment perpendicular to the axis of the transporter drum. This reduces binding of the rounds in the means engaging their extractor flanges.

The internal conveyor being driven through bevel gears 134, 136 and conveyor drive gear 132, these elements are all synchronous with rotation of the transporter ring at the end of the drum. The internal conveyor preferably consists of a welded tubular structure with radial shafts mounted vertically at each end for rotation of sprockets 120. On the front shaft, a one half inch pitch chain sprocket with a twenty tooth bevel gear attached on top is mounted, for engaging the corresponding bevel gear fixed to the conveyor drive gear. On the back or opposite side of the internal conveyor, only a chain sprocket is mounted. The shafts carrying the two conveyor sprockets 120 can be rotatably mounted on a support bar 146, shown in FIG. 7, extending the length of the drum. At the rear end, the support bar and the sprocket 120 are mounted on a corresponding radial arm, also rotatable on the central shaft of the transport drum.

The internal conveyor is preferably a one half inch pitch roller chain with one hundred eight partitions mounted on one and one quarter inch centers. These partitions maintain positive control of each round as it is moved from the longitudinal rails within the drum to the ring assembly, whereupon the rounds move circumferentially around to transition unit 32.

Figure 8:
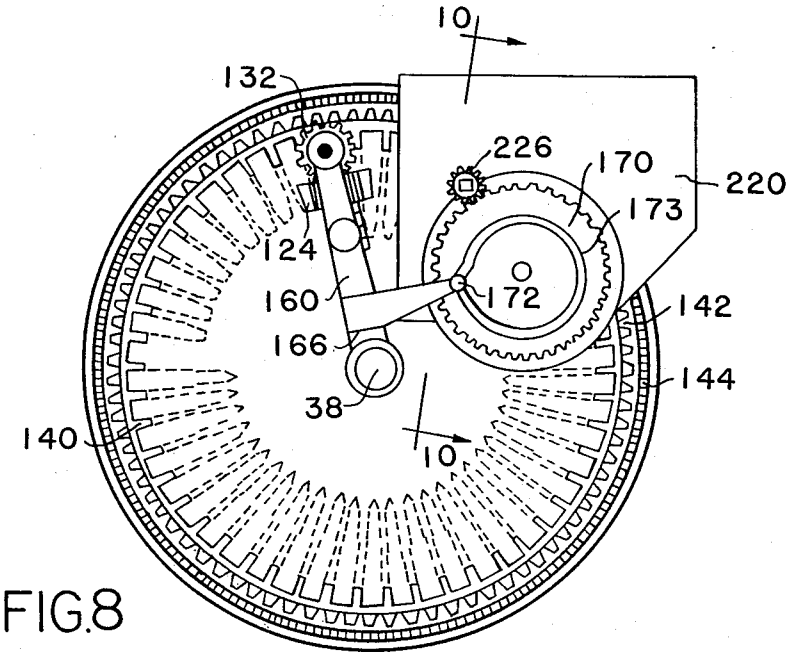
FIG. 8 is a cutaway end elevation view corresponding to FIG. 4, the stationary external housing shown cut away.

The arm carrying sprocket 120 and support bar 146 at the front end of the transport drum is oscillated as shown in FIG. 8. The front end arm i.e., oscillation arm 160, is rotatable around the central shaft 38 of the drum. During the time needed for transferring one full row, i.e., during one full rotation of transporter ring 140, the transporter inner drum frame rotates by an angular distance occuppied by said one row of rounds. During this time, by virtue of conveyor drive gear 132 and the relative rotation of the transporter ring 140, the chain 122 moves the full row of rounds from the current emptying row onto the transporter ring and from the transport ring returns a full row of spent rounds to a nearby current filling row. During this procedure, the row being filled and the row being emptied preferably are spaced by two empty rows immediately behind oscillating arm 160. This space is occupied by internal conveyor chain 122.

A cam 170 and cam follower 172 are mounted for relative movement of oscillating arm 160 such that arm 160 tracks along with the slow rotation of the transporter drum until a current row is completed, whereupon a step in cam groove 173 advances the oscillating arm to the next row while momentarily halting internal conveyor 122. Conveyor 122 then re-starts and during the time that this next row is being emptied, the oscillating arm once again slowly tracks along with the slowly rotating transporter drum. The transporter ring engaging conveyor drive ring 132 spins a full revolution between oscillations. To accomplish this motion, radial cam 170 and cam follower 172 are arranged with two sloping section in the groove of the cam, tracing a slow advance of arm 160 during loading/unloading and then a quick step-like retraction of arm 160 to move conveyor 122 up to the next row of rounds. The slope of the cam groove defining the step-like retraction is such that during this movement of the oscillating arm, the oscillating arm moves at substantially the same speed as the transporter ring. The conveyor 122 is positioned to move the next successive round into (or out of) the longitudinal rows as soon as the step on cam 170 is passed. Inasmuch as no relative displacement of ring 140 and conveyor drive gear 132 occurs during the step-like movement of arm 160, gear 132 is not turned and conveyor 122 remains stationary.

Figure 9:
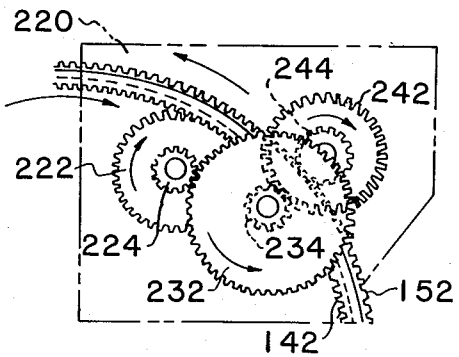
FIG. 9 is a schematic diagram of the gearbox shown in FIG. 8.

Cam 170 rotates according to the preferred embodiment on a shaft fixed on the stationary external housing of the transporter assembly. The gear assemblies for driving drum rotation, transporter ring rotation and cam rotation are shown in FIGS. 9 and 10. The particular gear sizes and teeth ratios can be changed without departing from the invention, for example in order to accommodate a different number of rounds in a row or in the transport ring. According to the preferred embodiment, the internal conveyor has one hundred eight partitions, of which a maximum of fifty engage rounds located on a longitudinal row. The one hundred eight partitions are one and one quarter inch centers, thereby maintaining a slight spacing between the rounds. This achieves more positive control of the rounds and less friction than possible when attempting to push an entire row of rounds from contact only at a rear one of the rounds.

The two gears mounted on the rotating shaft at the end of the oscillation arm include the conveyor drive gear 132, namely a sixteen tooth spur gear which meshes with the internal teeth of the ring assembly, and a bevel gear 136 which conveys rotation of conveyor drive gear 132 to conveyor sprocket 120. The ring assembly has two hundred fifty internal gear teeth for meshing with the conveyor drive gear 132. The transporter ring 140 also has on its axial end face three hundred sixty gear teeth, driven externally by transition unit 32, which in turn receives power from aircraft 24 or replenisher 26 through external conveyor 22. The rotatable transporter drum has external gear teeth 152 likewise driven from the gearbox, only much more slowly.

It is presently preferred that the spur gear mating with the shaft carrying the cam have a wrench-receiving adaptor 174 for a pneumatic wrench or the like. The device can thus be separately or even manually driven apart from the driving force provided, for example, by the gun emplacement to be loaded, said driving force being conveyed through the external conveyor 22.

During loading/unloading operations of the transporter apparatus, the transporter ring 140 and the inner drum 36 rotate in different directions and at different speeds. In particular, the inner drum 36 rotates counterclockwise and the transporter ring 140 rotates clockwise. The transporter ring completes its rotation during the passage of an entire row of rounds, for example fifty rounds, while the inner drum rotates only by the angular displacement of one row, approximately seven degrees. To achieve the necessary different directions and speeds, gear reductions and direction changes are effected by the connection of gears in the gearbox 220. There are three gear assemblies disposed in the gearbox, including a first gear assembly including the wrench-receiving adaptor 174, having a one half inch square hole for receipt of drive power for testing of the transporter, starting the transporter or otherwise manually forcing operation. In the normal course of events, however, the transition unit 32 positively engages connected links of chain such that the drive power at the gun emplacement will provide sufficient force through the connected links of the external conveyor chain to drive the entire transporter. The chain links also carry the rounds back and forth through the external conveyor.

In the first gear assembly, including the wrench-receiving adaptor 174, a forty tooth spur gear 222 meshes with the radially inward facing teeth 142 of the transporter ring 140. A thirteen tooth gear 224 meshes with a second gear assembly and a twelve tooth gear 226 meshes with the cam gear 248, which has seventy five teeth and is rigidly attached to cam 170. These gears of each respective gear assembly are carried rigidly on common shafts. The second gear assembly has a sixty tooth spur gear 232 and a twelve tooth spur gear 234, mounted on a common shaft, gear 232 meshing with gear 224 of said first gear assembly and gear 234 meshing with a third gear assembly. The third gear assembly has a forty tooth spur gear 242 and a sixteen tooth spur gear 244, mounted on a common shaft, the latter engaging on the external radially-outward gear teeth of the drum, i.e., having 325 teeth and being fixed to the inner drum frame 36. The result of this progression of gears is a reduction in ratio from the ring assembly to the inner drum of fifty to one and a direction change due to the interposition of said second gear assembly.

The cam assembly is also synchronized with rotation of the ring assembly and rotation of the drum. The cam gear assembly consists of a seventy five tooth spur gear 248 and a radial cam mounted together on a common shaft. The seventy five tooth gear 248 meshes with the twelve tooth spur gear 226 of the first gear assembly. The ratio between the ring assembly rotation and the cam gear assembly rotation is one to one. The final linking of the gearbox, cam gear assembly and drum to the pivoting of the internal conveyor is done through the drive link 166, shown in FIGS. 4 and 8. The axis of central shaft 38 of the drum and also the axes of cam 170 (on the radial outward side relative to shaft 38) being fixed with respect to the housing on the external frame, it will be appreciated that the drive arm basically operates as a cam follower that forces the internal conveyor to oscillate back and forth by the angular space of a row of rounds, around the axis defined by central shaft 38.

There are four main movements occurring simultaneously during operation of the transporter 20. The first is the constant clockwise rotation of the ring assembly at the loading rate required for feeding rounds to and from the aircraft or other gun emplacement. The second movement is the constant counter-clockwise rotation of the inner drum at 1/50 of the loading rate for the aircraft or gun emplacement. The third movement is the accelerating and decelerating movement of the internal conveyor that empties one row of rounds into the ring assembly while loading an empty row with spent cartridge cases and/or live rounds received from the ring assembly. The fourth movement is the pivoting of the internal conveyor that allows it to rotate with the inner drum until one rail is emptied, then to shift back in an oscillating manner to engage rounds for the next row.

The internal conveyor stops and starts in processing rows according to the embodiment shown. Conveyor drive gear 132, which is connected to operate internal conveyor 122, is rotated due to relative rotation with transporter ring 140. During the step-like movement of the oscillation arm 160 from one row to a next row, the conveyor drive gear 132 moves synchronously with rotation of the transporter ring and thus is not rotated and imparts no rotation to the bevel gears and therefore to the conveyor sprockets 120. Accordingly, during the brief advance from one row to a next row, the chain or belt 122 of the internal conveyor remains stationary, in position to place a next round in a next opening in the transporter ring. The now-stationary protrusions 124 of the internal conveyor thus mesh neatly with the fifty rounds in the next row to be loaded into the aircraft or gun emplacement. At the end of the step-like movement of arm 160, relative rotation of transporter ring 140 and conveyor drive gear 132 resumes, accelerating the internal conveyor and continuing as before.

Driving power to the transporter is applied to the axially outward facing gear teeth 144 on the face of the ring assembly 140 by mating gears on the transition unit 32 of the external conveyor assembly. As shown in FIGS. 1 and 2, the transition unit 32 is removably attached to the housing of the drum such that spur gears in the transition unit 32 engage the gear teeth 144 of ring 140. The spur gears in transition unit 32 are synchronized with sprockets that move the rounds through external conveyor 22. For testing, the transporter can be operated without the transition unit 32 in place, drive power being applied via wrench-receiving adaptor 174 of gear assembly number 1. During such testing, rounds remain inside the transporter, moving in a complete circle around ring 140. With unit 32 connected, the rounds can be passed out and back through the external conveyor in a bypass mode without entering the aircraft. When drive power is applied (by whatever means), the ring assembly constantly rotates clockwise at the designated speed. This drives the spur gear on the oscillation arm which drives the internal conveyor through mating bevel gears 134, 136. Simultaneously, the ring assembly rotation drives the inner drum at a constant counter clockwise rotation at one fiftieth of the ring assembly speed. Also simultaneously, the ring assembly rotation drives the cam to rotate at a one to one ratio (i.e., one rotation of the cam per one rotation of the transporter ring 140). Accordingly, as the ring assembly (and the cam) rotates one time, 50 round receptacles in the ring assembly pass by. The cam rotates once, and one rail in the internal drum with 50 rounds is either emptied or refilled At the moment of completion of the 50 rounds, the step in cam 170 arrives at cam follower 172. The spur gear 132 on the oscillation arm stops rotating and rides along with the clockwise rotation of the ring assembly as a result of the step on the radial cam, this step being arranged at the required angle and displacement to exactly track rotation of oscillating arm 160 by one row position at the same speed as rotation of the transporter ring 140. The internal conveyor stops during tracking, i.e., until the bottom of the step on cam 170 is reached by cam follower 172. During this time the internal conveyor chain 122 and its pusher protrusions 124 engage the next row of live rounds and/or move into the required position for filling the next empty row with spent rounds. As a result, a constant flow of ammunition moves into and out of the inner drum and the process repeats for all of the rails as the rounds of ammunition are cycled through in fifty round, one-rail sets.

Reverse operation is possible according to the present invention, but is normally not necessary in operation of devices of this type.

It is possible to operate the transporter drum of the invention to only load rounds from the drum into a gun emplacement, gun magazine or other device. In that case, the same mechanical operation is employed, however, spent ammunition is not returned to the drum. It is also possible to operate the device without using the external conveyor chain as a driving means, hydraulic motors, electric motors or other means being provided for driving the respective chains, drums and gears.

A transporter according to the invention for storing and feeding linkless rounds of ammunition, namely at least one of live rounds and spent cartridge casings, has a generally cylindrical drum frame assembly defining an axis and having a plurality of longitudinally aligned rails facing inwardly toward the axis, the rails having means engaging bases of the rounds for retaining the rounds between adjacent ones of the rails in rows receiving a plurality of said rounds. An internal conveyor loads and unloads the rounds along successive ones of the rows, the internal conveyor having means engaging at least one of the rounds in successive ones of the rows, said means being movable longitudinally of the axis. Drive means operatively connect the drum frame assembly and the internal conveyor, the drive means operating the internal conveyor to move said rounds and the drive means also indexing the internal conveyor from one row to a next successive row upon completion of said one row. The internal conveyor preferably includes at least two oppositely movable drive means for loading one of rounds and spent casings into one row while unloading one of rounds and spent casings from another row. The internal conveyor can have a chain drive with two endless loops arranged parallel to the axis and a gearbox operable to synchronize movement of said loops with relative motion of the drum frame assembly and the internal conveyor, such that the internal conveyor is fixed relative to the drum while moving rounds in a row and is indexed from that row to a next row upon completion of that row.

The drive means rotates the drum and a cam and cam follower are driven by the gearbox to accomplish a step-like indexing motion, the internal conveyor being positioned at least in part by the cam and the cam follower. The cam has a gradual slope for holding the internal conveyor in fixed position relative to the drum and a step for advancing the internal conveyor upon said completion of a row. A ring assembly disposed at an end of the drum frame assembly carries the rounds circumferentially around the drum and passes the rounds to the internal conveyor. The inner drum frame is rotated about its axis during loading and unloading, having a circumferential gear engaging with the drive means and the ring assembly also having a circumferential gear engaging with the internal conveyor. The ring assembly is drivable from power received through an external conveyor. The internal conveyor is mounted on and driven due to relative movement of the ring and an arm pivotable around said axis. The cam is rotatable around an axis parallel to and radially spaced from said axis of the drum frame assembly for oscillating the arm.

The invention may also be characterized as a storage and feeding apparatus for linkless rounds of ammunition including live rounds and spent cartridge casings comprising a housing, a transporter drum mounted on the housing for rotation about an axis, the transporter drum defining an inner circumferential wall with a plurality of rails aligned parallel to the axis, the rails having guide means slidably engaging extractor flanges on the rounds to retain the rounds in longitudinal rows between adjacent rails, a transporter ring disposed at one end of the drum, the transporter ring being rotatable relative to the drum around the axis and having means retaining the rounds in a circumferential row, an external conveyor operable to convey rounds to and from the transporter ring, an internal conveyor operable to push the rounds along successive ones of the longitudinal rows, for transfer into the transporter ring for unloading the drum, and for transfer out of the transporter ring for loading the drum, respectively, the internal conveyor being geared to the transporter ring and driven by relative displacement with the transport ring; and, a drive and gearing means engaging and driving the drum, the external conveyor and the transporter ring, the drive and gearing means moving the internal conveyor in a stepwise motion from one of the longitudinal rows to a next successive longitudinal row upon completion of said loading and unloading for said plurality of rounds in said one of the rows, relative displacement of the internal conveyor ceasing during said stepwise motion, whereupon the internal conveyor stops momentarily, the drive and gearing means relatively rotating the drum and the internal conveyor at equal speed during said stepwise motion advancing the internal conveyor and retaining the drum and the internal conveyor relative to one another while loading and unloading the row.

The internal conveyor has at least one conveying pusher movable parallel to the longitudinal rows, the pusher contacting at least an endmost round in the row. The internal conveyor is mounted on an arm disposed radially of the axis of the drum. Cam means having a first cam surface slowly advance the arm relative to the housing in synchronism with rotation of the drum, and the cam means have a step for moving the internal conveyor to a next one of the longitudinal rows. The drive and gearing means moving the internal conveyor and the cam means such that the step is reached by the cam means upon completion of one row of rounds.

The internal conveyor has at least one endless chain loop carrying the pusher, the endless chain loop being carried by sprockets supported by parallel arms disposed radially of the drum at opposite ends of the drum, whereby the pusher moves along a line parallel to the rows and parallel to the axis.

The invention is an improvement on linkless ammunition storage and transport devices of the type having a of longitudinal rails around an inward facing of a cylindrical drum and means for supplying and removing rounds of ammunition in a form of at least one of live and spent cartridge casings, to and from a transport at an end of the drum, the improvement including the internal conveyor with a pusher movable along a line between adjacent ones of the rails, the internal conveyor being movably mounted to rotate as a unit around a central axis of the drum while maintaining the line parallel to the central axis and parallel to the rails, and the drive means momentarily advancing the internal conveyor relative to the drum from one row to a next row upon the pusher completing a transit of one row and the drive means synchronously advance both the drum and the internal conveyor during said transit.

The improvement includes the housing supporting the drum for rotation about the central axis, the internal conveyor being mounted on at least one arm disposed radially of the central axis and the drive means having a cam and cam follower for controlling momentary and synchronous movements of the internal conveyor relative to the drum, one of the cam and the cam follower being attached to the arm and the other of the cam and the cam follower being fixed relative to the housing, the cam having a first shaped surface moving the arm in synchronism with rotation of the drum such that the internal conveyor remains fixed relative to the drum during transit of the internal conveyor along one of the rails, the cam having a second shaped surface defining a stepwise advance of the internal conveyor from one rail to a next rail.

The invention having been disclosed, a number of additional embodiments will now become apparent to persons skilled in the art. Reference should be made to the appended claims rather than the foregoing specification as indicating the true scope of the invention.

We claim:

1. A transporter for storing and feeding linkless rounds of ammunition, the ammunition being at least one of live rounds and spent cartridge casings, the transporter comprising:

a generally cylindrical drum frame assembly defining an axis and having a plurality of longitudinally aligned rails facing inwardly toward the axis, the rails having means for engaging bases of the rounds for retaining the rounds between adjacent ones of the rails in rows receiving a plurality of said rounds;

an internal conveyor operable for one of loading and unloading the rounds along successive ones of the rows, the internal conveyor having means engaging at least one of the rounds in successive ones of the rows, said means being movable longitudinally of the axis; and, drive means operatively connecting the drum frame assembly and the internal conveyor, the drive means operating the internal conveyor to move said rounds and the drive means also stepwise advancing the internal conveyor from one row to a next successive row upon completion of said one row.

2. The transporter of claim 1, further comprising a ring assembly disposed at an end of the drum frame assembly, the ring assembly carrying the rounds circumferentially around the drum and passing the rounds to the internal conveyor.

3. The transporter of claim 1, wherein the internal conveyor includes section moving in opposite directions, the sections loading one of rounds and spent casings into one row while unloading one of rounds and spent casings from another row.

4. The transporter of claim 3, wherein the internal conveyor has a chain drive with an endless loop with two oppositely moving sections arranged parallel to the axis and the drive means has a gear box operable to synchronize movement of said loops with relative motion of the drum frame assembly and the internal conveyor, such that the internal conveying is fixed relative to the drum while moving rounds in a row and is stepwise indexed from that row to a next row upon completion of that row.

5. The transporter of claim 4, wherein the drive means rotates the drum and further comprising a cam and cam follower driven by the gearbox, the internal conveyor being positioned at least in part by the cam and the cam follower, the cam having a gradual slope for holding the internal conveyor in fixed position relative to the drum and a step for advancing the internal conveyor upon said completion of a row.

6. The transporter of claim 5, wherein the drum frame assembly has a drum rotated about said axis during loading and unloading, the drum and the ring assembly each having a circumferential gear engaging with the drive means and the ring assembly also having a circumferential gear engaging with the internal conveyor, said circumferential gears being parts of said drive means, the internal conveyor being mounted on an arm pivotable around said axis and the cam being rotatable around an axis parallel to and radially spaced from said axis of the drum frame assembly.

7. A storage and feeding apparatus for linkless rounds of ammunition including live rounds and spent cartridge casings, the apparatus comprising:

a housing;

a transporter drum mounted on the housing for rotation about an axis, the transporter drum having a plurality of rails aligned, parallel, to the axis, the rails having guide means for slidably engaging extractor flanges on the rounds to retain the rounds in longitudinal rows between adjacent rails;

a transporter ring disposed at one end of the drum, the transporter ring being rotatable relative to the drum around the axis and having means retaining the rounds in a circumferential row;

an external conveyor operable to convey rounds to and from the transporter ring;

an internal conveyor operable to push the rounds along successive ones of the longitudinal rows, for transfer into the transporter ring for unloading the drum, and for transfer out of the transporter ring for loading the drum, respectively, the internal conveyor being geared to the transporter ring and driven by relative displacement of the internal conveyor and the transport ring; and, a drive and gearing means engaging and driving the drum, the external conveyor and the transporter ring, the drive and gearing means moving the internal conveyor in a stepwise motion from one of the longitudinal rows to a next successive longitudinal row upon completion of said loading and unloading for said plurality of rounds in said one of the rows, relative displacement of the internal conveyor and transporter ring ceasing during the stepwise motion, whereupon the internal conveyor momentarily stops, the drive and gearing means relatively rotating the drum and the internal conveyor at equal speeds during said stepwise motion advancing the internal conveyor and retaining the drum and the internal conveyor relative to one another while loading and unloading the row.

8. The apparatus of claim 7, wherein the internal conveyor has at least one conveying pusher movable parallel to the longitudinal rows, the pusher contacting at least an endmost round in the row, and the internal conveyor is mounted on an arm disposed radially of the axis of the drum, and further comprising cam means having a first cam surface slowly advancing the arm relative to the housing in synchronism with rotation of the drum, and the cam means having a step for moving the internal conveyor to a next one of the longitudinal rows, the drive and gearing means moving the internal conveyor and the cam means such that the step is reached by the cam means upon completion of one row of rounds.

9. The apparatus of claim 8, wherein the internal conveyor has at least one endless chain loop carrying the pusher, the endless chain loop being carried by sprockets supported by parallel arms disposed radially of the drum at opposite ends of the drum, whereby the pusher moves along a line parallel to the rows and parallel to the axis.

10. An improved linkless ammunition storage and transport device of the type having a plurality of longitudinal rails around an inward facing surface of a cylindrical drum and means for supplying and removing rounds of ammunition in a form of at least one of live rounds and spent cartridge casings, to and from a transport means at an end of the drum, the improvement comprising:

an internal conveyor with a pusher movable along a line between adjacent ones of the rails, the internal conveyor being movably mounted to rotate as a unit around a central axis of the drum while maintaining the line parallel to the central axis and parallel to the rails;

a drive means momentarily stepwise advancing the internal conveyor relative to the drum from one row to a next row upon the pusher completing a transit of one row and the drive means synchronously advancing both the drum and the internal conveyor during said transit.

11. The improved device of claim 10, wherein the internal conveyor is mounted on at least one arm disposed radially of the central axis and the drive means having a cam and cam follower for controlling momentary and synchronous movements of the internal conveyor relative to the drum, one of the cam and the cam follower being attached to the arm and the other of the cam and the cam follower being fixed relative to the housing, the cam having a first shaped surface moving the arm in synchronism with rotation of the drum such that the internal conveyor remains fixed relative to the drum during transit of the internal conveyor along one of the rails, the cam having a second shaped surface defining a stepwise advance of the internal conveyor from one rail to a next rail.

12. The improved device of claim 10, further comprising a transporter ring disposed on an end of the drum, the transporter ring receiving the rounds and directing the rounds in a circular motion, the internal conveyor being geared to the transporter ring and the internal conveyor having power transmission means for conveying power to the transporter ring.

13. The improved device of claim 10, further comprising a housing supporting the drum for rotation about the central axis.

* * * * *